US011913297B1

(12) United States Patent
Alotaibi et al.

(10) Patent No.: US 11,913,297 B1
(45) Date of Patent: Feb. 27, 2024

(54) METHOD AND APPARATUS FOR DEPLOYING AND CEMENTING LINERS ACROSS CHALLENGING WELL PROFILES

(71) Applicant: SAUDI ARABIAN OIL COMPANY, Dhahran (SA)

(72) Inventors: Abdullah H. Alotaibi, Riyadh (SA); Saad M. Budair, Dhahran (SA); Hezam H. Alhajri, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/087,001

(22) Filed: Dec. 22, 2022

(51) Int. Cl.

| | |
|---|---|
| ***E21B 34/10*** | (2006.01) |
| ***E21B 23/04*** | (2006.01) |
| ***E21B 33/14*** | (2006.01) |
| ***E21B 10/26*** | (2006.01) |
| ***E21B 34/14*** | (2006.01) |
| ***E21B 4/02*** | (2006.01) |

(52) U.S. Cl.
CPC ..... *E21B 23/042* (2020.05); *E21B 4/02* (2013.01); *E21B 10/26* (2013.01); *E21B 33/14* (2013.01); *E21B 34/10* (2013.01); *E21B 34/142* (2020.05)

(58) Field of Classification Search
CPC ..... E21B 34/142; E21B 33/14; E21B 34/10
USPC ..... 166/285
See application file for complete search history.

(56) References Cited

U.S. PATENT DOCUMENTS

| | | | | |
|---|---|---|---|---|
| 6,604,921 | B1 * | 8/2003 | Plop | F03C 2/08 418/153 |
| 8,839,870 | B2 * | 9/2014 | Ring | E21B 43/105 166/383 |
| 10,378,308 | B2 * | 8/2019 | Moffitt | E21B 43/10 |
| 2011/0011646 | A1 * | 1/2011 | Giroux | E21B 41/0078 175/45 |
| 2012/0048619 | A1 * | 3/2012 | Seutter | E21B 7/24 175/122 |
| 2015/0136393 | A1 * | 5/2015 | Turley | E21B 23/01 166/382 |

* cited by examiner

*Primary Examiner* — William D Hutton, Jr.
*Assistant Examiner* — Ashish K Varma
(74) *Attorney, Agent, or Firm* — Osha Bergman Watanabe & Burton LLP

(57) ABSTRACT

A system includes a tubular body, a pressure actuated circulation valve, a first power section, an isolation valve, and a housing. The pressure actuated circulation valve is connected to the tubular body. The first power section is configured to rotate when a fluid is pumped from the pressure actuated circulation valve. The isolation valve is connected to the first power section. The isolation valve comprises a plurality of openings each having a different area and the fluid is exposed to a plurality of different flow path areas. The housing is connected to the isolation valve and comprises a set of springs connected to a piston. The set of springs are configured to pulsate the piston in response to the fluid being pumped through the plurality of different flow path areas and pulsation of the piston creates an axial force acting on the tubular body.

20 Claims, 6 Drawing Sheets

METHOD AND APPARATUS FOR DEPLOYING AND CEMENTING LINERS ACROSS CHALLENGING WELL PROFILES

BACKGROUND

Hydrocarbons are located in porous rock formations far beneath the surface of the Earth. Wells are drilled into the formations to access and produce the hydrocarbons. Wells are created by drilling a wellbore into the surface of the Earth. The wellbore is supported by large diameter pipes connected together and cemented in place. These large diameter pipes connected together are called casings strings or liner strings. Wells are often drilled to significant depths along challenging well profiles due to the location of various subsurface formations that must be avoided during drilling. In such scenarios, it is difficult to run the casing strings or liner strings to the planned depth using conventional technology.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems for tripping and cementing a tubular in a well. The system, in accordance with one or more embodiments, includes a tubular body, a pressure actuated circulation valve, a first power section, an isolation valve, and a housing. The tubular body is deployed in a wellbore. The pressure actuated circulation valve is connected to the tubular body and has a cementing position and a tripping position. The pressure actuated circulation valve is configured to be placed in the cementing position while the tubular body is being cemented in the wellbore and the pressure actuated circulation valve is configured to be placed in the tripping position while the tubular body is being lowered into the wellbore. The first power section is connected to the pressure actuated circulation valve. The first power section is configured to rotate when a fluid is pumped from the pressure actuated circulation valve in the tripping position. The isolation valve is connected to the first power section. The isolation valve comprises a plurality of openings each having a different area and the fluid is exposed to a plurality of different flow path areas when the first power section rotates, and the fluid is pumped through the plurality of openings. The housing is connected to the isolation valve and comprises a set of springs connected to a piston. The set of springs are configured to pulsate the piston in response to the fluid being pumped through the plurality of different flow path areas and pulsation of the piston creates an axial force acting on the tubular body.

The method, in accordance with one or more embodiments, includes connecting a tubular body to a downhole tool, the downhole tool comprising a pressure actuated circulation valve having a cementing position and a tripping position, a first power section, an isolation valve, and housing comprising a set of springs connected to a piston. The method also includes placing the pressure actuated circulation valve in the tripping position, tripping the tubular body and the downhole tool into a wellbore by lowering the tubular body into the wellbore, and pumping a fluid through the tubular body and the downhole tool to rotate the first power section. The method further includes exposing the fluid to a plurality of different flow path due to rotation of the first power section and the isolation valve comprising a plurality of different openings each having different areas and applying an axial force to the tubular body by pulsating the piston using the set of springs responding to the fluid being pumped through the plurality of different flow path areas.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
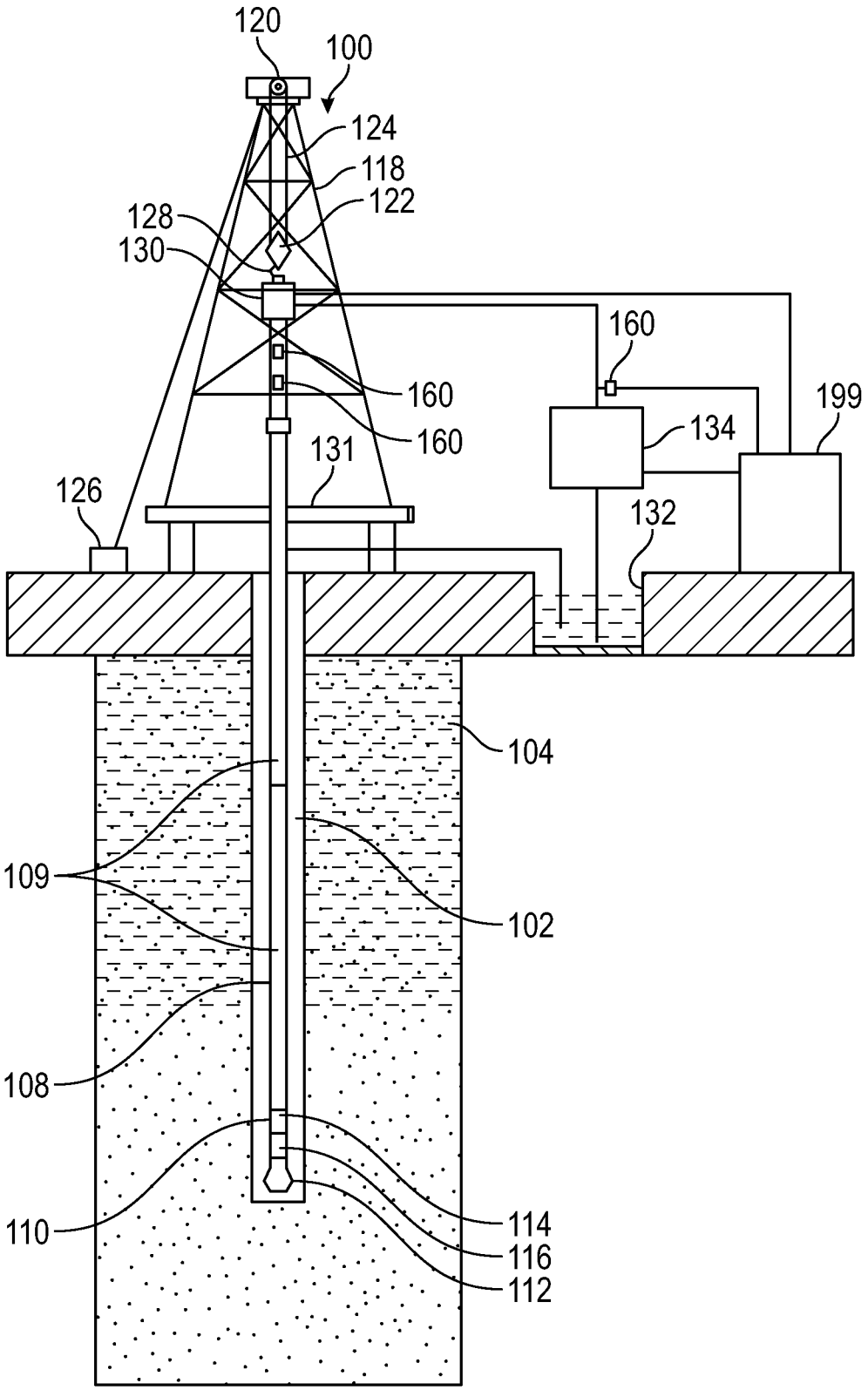
FIG. 1 shows an example well site in accordance with one or more embodiments.

FIG. 1 shows an example well site (100) in accordance with one or more embodiments. In general, well sites may be configured in a myriad of ways. Therefore, well site (100) is not intended to be limiting with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (104). For the purpose of drilling a new section of wellbore (102), a drill string (108) is suspended within the wellbore (102).

The drill string (108) may include one or more drill pipes (109) connected to form conduit and a bottom hole assembly (BHA) (110) disposed at the distal end of the conduit. The BHA (110) may include a drill bit (112) to cut into the subsurface rock. The BHA (110) may include measurement tools, such as a measurement-while-drilling (MWD) tool (114) and logging-while-drilling (LWD) tool 116. Measurement tools (114, 116) may include sensors and hardware to measure downhole drilling parameters, and these measurements may be transmitted to the surface using any suitable telemetry system known in the art. Herein, the term surface is defined as any location located outside of the wellbore (102), such as somewhere on the Earth's surface, on a man-made object located on the Earth's surface, etc. The BHA (110) and the drill string (108) may include other drilling tools known in the art but not specifically shown.

The drill string (108) may be suspended in wellbore (102) by a derrick (118). A crown block (120) may be mounted at the top of the derrick (118), and a traveling block (122) may hang down from the crown block (120) by means of a cable or drilling line (124). One end of the cable (124) may be connected to a draw works (126), which is a reeling device that may be used to adjust the length of the cable (124) so that the traveling block (122) may move up or down the derrick (118). The traveling block (122) may include a hook (128) on which a top drive (130) is supported.

The top drive (130) is coupled to the top of the drill string (108) and is operable to rotate the drill string (108). Alternatively, the drill string (108) may be rotated by means of a rotary table (not shown) on the drilling floor (131). Drilling fluid (commonly called mud) may be stored in a mud pit (132), and at least one pump (134) may pump the mud from the mud pit (132) into the drill string (108). The mud may flow into the drill string (108) through appropriate flow paths in the top drive (130) (or a rotary swivel if a rotary table is used instead of a top drive to rotate the drill string (108)).

In one implementation, a system (199) may be disposed at or communicate with the well site (100). System (199) may control at least a portion of a drilling operation at the well site (100) by providing controls to various components of the drilling operation. In one or more embodiments, system (199) may receive data from one or more sensors (160) arranged to measure controllable parameters of the drilling operation. As a non-limiting example, sensors (160) may be arranged to measure WOB (weight on bit), RPM (drill string rotational speed), GPM (flow rate of the mud pumps), and ROP (rate of penetration of the drilling operation).

Sensors (160) may be positioned to measure parameter(s) related to the rotation of the drill string (108), parameter(s) related to travel of the traveling block (122), which may be used to determine ROP of the drilling operation, and parameter(s) related to flow rate of the pump (134). For illustration purposes, sensors (160) are shown on drill string (108) and proximate mud pump (134). The illustrated locations of sensors (160) are not intended to be limiting, and sensors (160) could be disposed wherever drilling parameters need to be measured. Moreover, there may be many more sensors (160) than shown in FIG. 1 to measure various other parameters of the drilling operation. Each sensor (160) may be configured to measure a desired physical stimulus.

During a drilling operation at the well site (100), the drill string (108) is rotated relative to the wellbore (102), and weight is applied to the drill bit (112) to enable the drill bit (112) to break rock as the drill string (108) is rotated. In some cases, the drill bit (112) may be rotated independently with a drilling motor. In further embodiments, the drill bit (112) may be rotated using a combination of the drilling motor and the top drive (130) (or a rotary swivel if a rotary table is used instead of a top drive to rotate the drill string (108)). While cutting rock with the drill bit (112), mud is pumped into the drill string (108).

The mud flows down the drill string (108) and exits into the bottom of the wellbore (102) through nozzles in the drill bit (112). The mud in the wellbore (102) then flows back up to the surface in an annular space between the drill string (108) and the wellbore (102) with entrained cuttings. The mud with the cuttings is returned to the pit (132) to be circulated back again into the drill string (108). Typically, the cuttings are removed from the mud, and the mud is reconditioned as necessary, before pumping the mud again into the drill string (108). In one or more embodiments, the drilling operation may be controlled by the system (199).

Innovations in drilling operations, such as extended reach drilling, directional drilling, etc., allow for previously unreachable hydrocarbon reservoirs to be accessed. In order to access these hydrocarbon reservoirs, the wellbore (102) may be drilled at various angles and trajectories due to surface constraints and/or locations of undesirable subsurface geometries. As such, the resulting wellbore (102) may have a challenging profile.

While these hydrocarbon reservoirs may be accessed using a drill string (108) having a bottom hole assembly (110) and a drill bit (112), new complications arise when tripping larger diameter tubular bodies, such as casing strings or liner strings, to the required depth in the wellbore (102). Casing strings and liner strings are made of a plurality of large diameters pipes connected to one another. A casing string extends from the surface of the wellbore (102) to a depth within the wellbore (102) whereas a liner string only extends from and is set within a previously-set casing string or liner string, not the surface.

Conventionally these tubular bodies are simply lowered into the wellbore (102) and the weight of the tubular body allows the tubular body to reach the required depth. However, due to the presence of challenging wellbore (102) profiles, larger diameter tubular bodies are unable to be tripped to the required depth and the wellbore (102) is unable to be completed and produced from.

In view of the above, systems and methods that allow a casing string or a liner string to be tripped to the required depth in a challenging wellbore (102) profile is beneficial. As such, the present disclosure presents a downhole tool that allows casing strings or liner strings to be deployed and cemented across challenging wellbore (102) profiles.

The downhole tool provides double motion on the bottom of the tubular body while maintaining the ability to efficiently cement the tubular body in place in the wellbore (102). Specifically, the downhole tool allows for axial and rotational motion to be delivered to the bottom of the tubular body.

The combination of axial and rotational motion allows the tubular body to overcome high friction and ledges in the wellbore (102). Once the tubular body has been tripped to the required depth, a circulation valve, located in the downhole tool, is activated in order for cement to be placed into the annulus created between the tubular body (258) and the wellbore (102) wall.

Figure 2A:
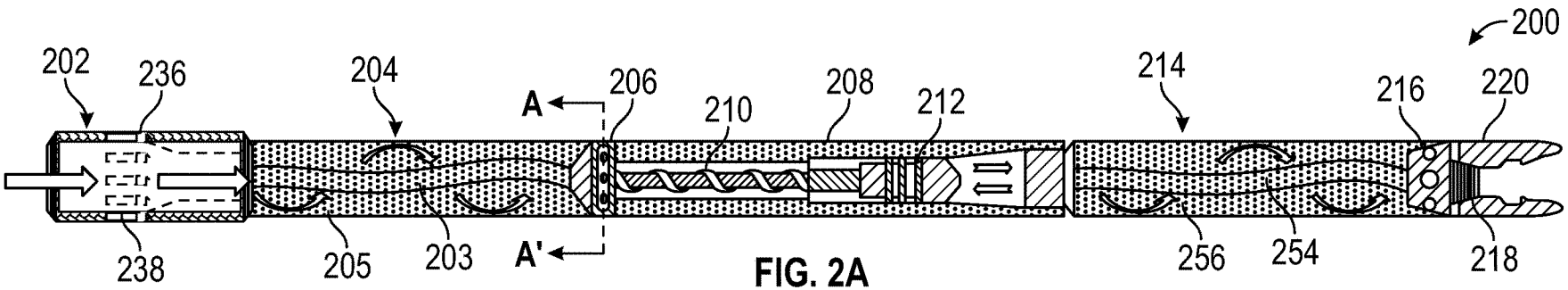
FIGS. 2*a*-2*c* shows a downhole tripping and cementing tool in accordance with one or more embodiments.
Figure 2B:
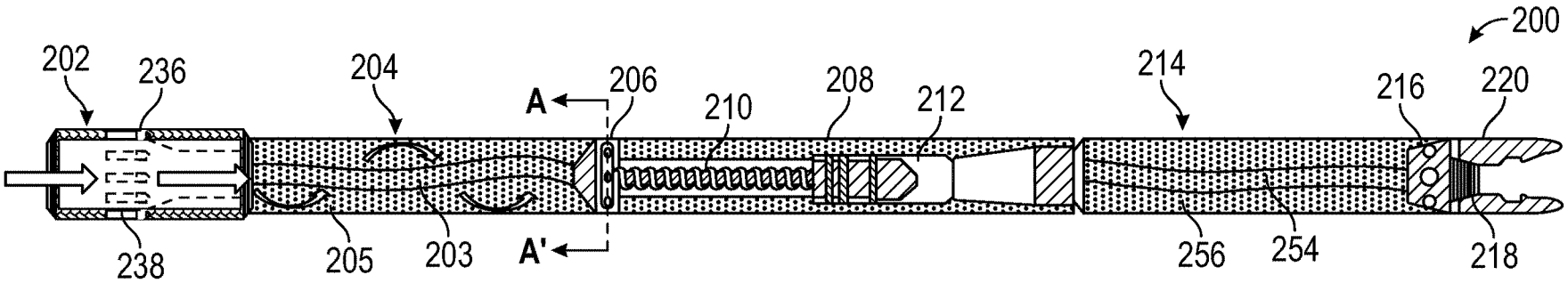
Figure 2C:
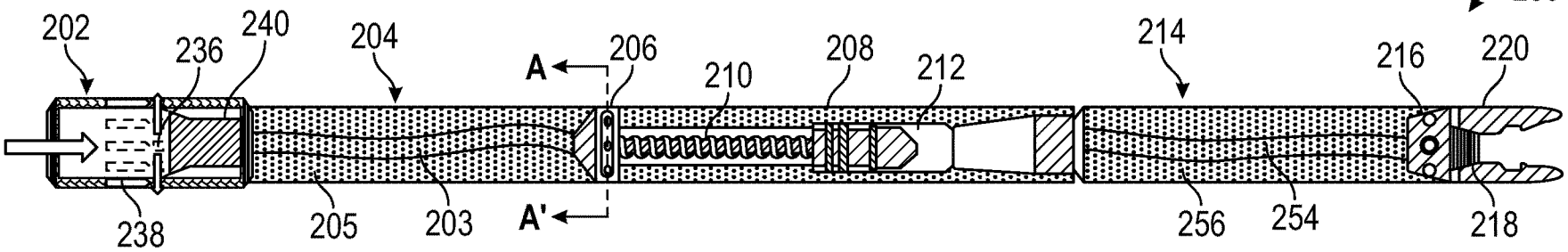

FIGS. 2*a*-2*c* show a downhole tripping and cementing tool (200) in accordance with one or more embodiments. Specifically, FIG. 2*a* shows the downhole tripping and cementing tool (200) in an active position. FIG. 2*b* shows the downhole tripping and cementing tool (200) in an inactive position. FIG. 2*b* shows the downhole tripping and cementing tool (200) in a cementing position.

In accordance with one or more embodiments, the downhole tripping and cementing tool (200) is made of a pressure actuated circulation (PAC) valve (202), a first power section (204), an isolation valve (206), a housing (208) comprising a set of springs (210) and a piston (212), a second power section (214), a fixed valve (216), a rotational valve (218), and a reamer (220).

In accordance with one or more embodiments, the aforementioned components are connected to one another in the order shown in FIGS. 2*a*-2*c*. The components may be directly or indirectly connected to one another in the order shown in FIGS. 2*a*-2*c* without departing from the scope of the disclosure herein. The components may be connected to one another using any connection means known in the art, such as a threaded connection, a welded connection, a bolt and flange connection, etc. Further, the aforementioned components may be made out of any combination of material known in the art, such as a steel alloy, rubber, etc.

Figure 3A:
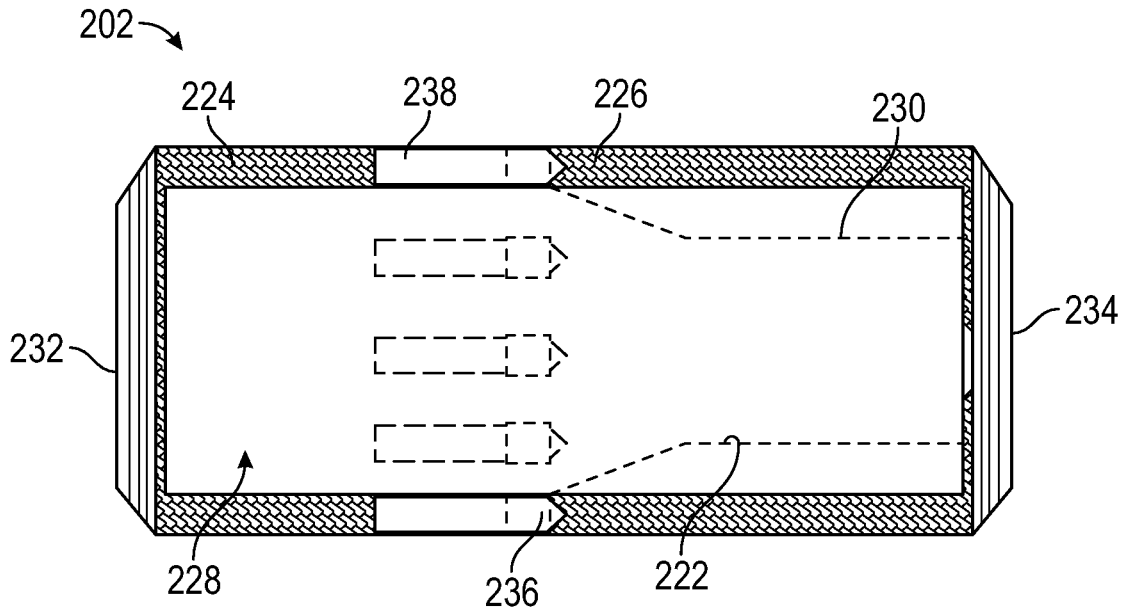
FIGS. 3*a* and 3*b* show a pressure actuated circulation valve in accordance with one or more embodiments.
Figure 3B:
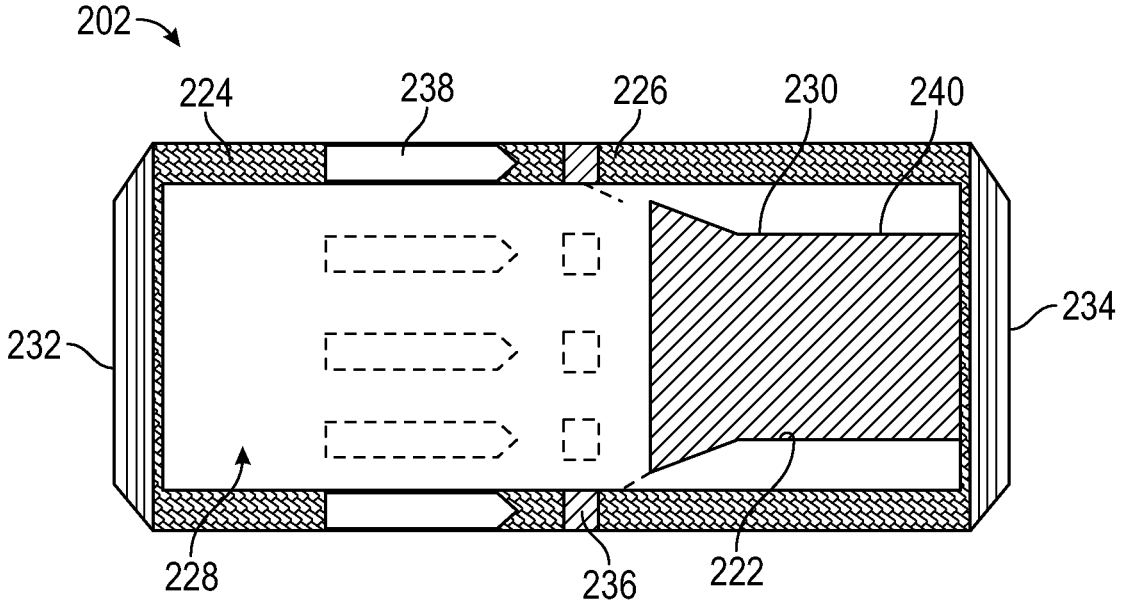

The PAC valve (202) is further outlined in FIGS. 3*a* and 3*b*. Specifically, FIG. 3*a* shows the PAC valve (202) in a tripping position, and FIG. 3*b* shows the PAC valve (202) in a cementing position. The PAC valve (202) is a tubular having an inner circumferential surface (222) and an external circumferential surface (224). The material located between the inner circumferential surface (222) and the external circumferential surface (224) is the wall (226) of the PAC valve (202).

The inner circumferential surface (222) defines an orifice (228) and delineates a dart seat (230). The orifice (228) extends from a first end (232) the PAC valve (202) to a second end (234) of the PAC valve (202) such that a fluid may flow through the PAC valve (202) from the first end (232) to the second end (234). The PAC valve (202) comprises a plurality of circulation ports (236) that extend through the wall (226) of the PAC valve (202) from the inner circumferential surface (222) to the external circumferential surface (224) such that the orifice (228) may be hydraulically connected to an external environment through the plurality of circulation ports (236).

A plurality of sleeves (238) are located on the PAC valve (202). The sleeves (238) may be located within the wall (226) of the PAC valve (202), on the inner circumferential surface (222) of the PAC valve (202), or on the external circumferential surface (224) of the PAC valve (202) without departing from the disclosure herein. The sleeves (238) may be pressure actuated.

In the tripping position, the sleeves (238) are situated in such a way that they cover, or block, the circulation ports (236), as shown in FIG. 3*a*. Thus, in the tripping position, there is no hydraulic connection between the orifice (228) and the external environment through the circulation ports (236). However, in the tripping position, a hydraulic connection may still exist through the PAC valve (202) from the first end (232) to the second end (234).

The dart seat (230), formed by the inner circumferential surface (222) of the PAC valve (202), is designed to receive a dart (240). Herein, the term dart (240) refers to any object that may be pumped into the PAC valve (202) to land in the dart seat (230) and block a fluid from flowing through the PAC valve (202) from the first end (232) to the second end (234). The dart (240) may be solid, as shown in FIG. 3*b*, or the dart may be hollow with a rupture disk. Further, the dart (240) may be a cement or wiper plug without departing from the scope of the disclosure herein.

Once the dart (240) is landed on the dart seat (230), pressure may be built on the dart (240) by pumping a fluid on top of the dart (240). The pressure build up causes the sleeves (238) to uncover the plurality of circulation ports (236) placing the orifice (228) in hydraulic communication with an external environment through the circulation ports (236). The cementing position of the PAC valve (202) is defined when the dart (240) is landed in the dart seat (230) and the sleeves (238) are uncovering the circulation ports (236), as shown in FIG. 3*b*.

In further embodiments, when pressure is released from on top of the dart (240), the sleeves (238) retract to the tripping position (i.e., covering the circulation ports (236)). The first end (232) of the PAC valve (202) may be used to connect the PAC valve (202) to a tubular body, such as a casing string or a liner string. The second end (234) of the PAC valve (202) may be used to connect the PAC valve (202) to the first power section (204) as shown in FIGS. 2*a*-2*c*.

Turning back to FIGS. 2*a*-2*c*, the active and the inactive position of the downhole tripping and cementing tool (200) are partly defined by the PAC valve (202) being placed in the tripping position, as shown in FIG. 3*a*. The cementing position of the downhole tripping and cementing tool (200) is defined by the PAC valve (202) being placed in the cementing position, as shown in FIG. 3*b*.

The first power section (204) comprises a first rotor (203) disposed in a first stator (205). The first power section (204) is configured to rotate, using the first rotor (203) and the first stator (205), when a fluid is pumped from the PAC valve (202), placed in the tripping position. The first power section (204) is connected to the isolation valve (206). The first stator (205) and the first rotor (203) work in tandem to rotate the first rotor (203). In accordance with one or more embodiments, the first stator (205) acts as an outer gear and may be made from a molded elastomer featuring at least two lobes. The outer diameter of the elastomer may be protected by a secure casing made of metal.

The first rotor (203) is positioned within the first stator (205) and acts as an internal gear. The first rotor (203) may be made of metal and will have one less gear or lobe than the first stator (205). Because of this difference, a cavity is created between the first stator (205) and the first rotor (203). When a fluid is pumped from the PAC valve (202) to the first power section (204), the fluid may fill the cavity. With continued fluid pressure applied to the fluid in the cavity, the cavity acts as a wedge and causes the first rotor (203) to rotate.

The active position of the downhole tripping and cementing tool (200) is partially defined as when fluid is being pumped from the PAC valve (202), in the tripping position, to the remainder of the downhole tripping and cementing tool (200), as shown in FIG. 2*a*. The inactive position of the downhole tripping and cementing tool (200) is partially defined as when fluid is not being pumped through the PAC valve (202), in the tripping position, to the remainder of the downhole tripping and cementing tool (200).

Figure 4:
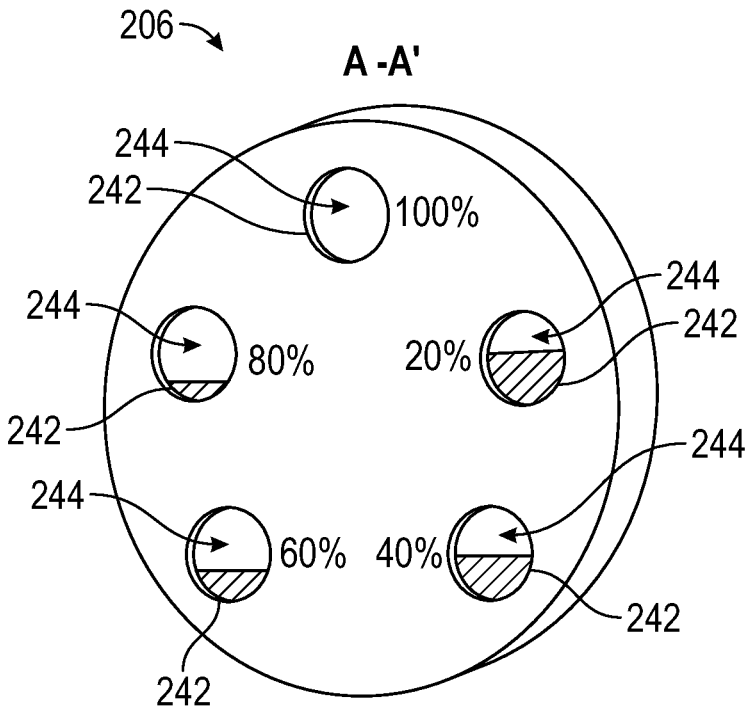
FIG. 4 shows an isolation valve in accordance with one or more embodiments.

The first power section (204) is connected to the housing (208) via the isolation valve (206). The isolation valve (206) is in a fixed position as the first rotor (203) of the first power section (204) rotates. The isolation valve (206) is further shown along axis A-A' in FIG. 4. The isolation valve (206) has a plurality of openings (242). Each opening (242) has a different area (244) through which the fluid may flow as shown in FIG. 4. The area (244) of each opening (242) may be determined by how much of the opening (242) is blocked off. For example, and as shown in FIG. 4, one opening (242) may have no blockage so the area (244) is 100% of the opening (242) size. The other openings (242) have variable amounts of blockage making the areas (244) be 80%, 60%, 40%, and 20% of the opening (242) size.

As the first rotor (203) rotates, the fluid flowing through the downhole tripping and cementing tool (200) is exposed to the plurality of different flow path areas (244) in the isolation valve (206). The springs (210) are connected to the isolation valve (206) and the piston (212). As the fluid is exposed to the plurality of different flow path areas (244), the springs (210) expand and contract causing the piston (212) to pulsate. Pulsation of the piston (212) creates an axial force which may act on the tubular body when the tubular body is connected to the downhole tripping and cementing tool (200).

In accordance with one or more embodiments, the springs (210) are made in compression. When the fluid passes through the piston (212), the springs (210) will be in tension. When the flow stops, the springs (210) will revert back to being under compression. Using the areas (244) of the openings (242) shown in FIG. 4 as an example, when the fluid passes through the opening (242) having 100% area, the springs (210) will be at 100% tension. When the flow passes through the opening (242) having 80% area, the spring (210) will partially retract to being in compression and the springs (210) will be at 80% tension, when the flow passes through the opening (242) having 60% area, the spring (210) will be at 60% tension, and so on.

Figure 5:
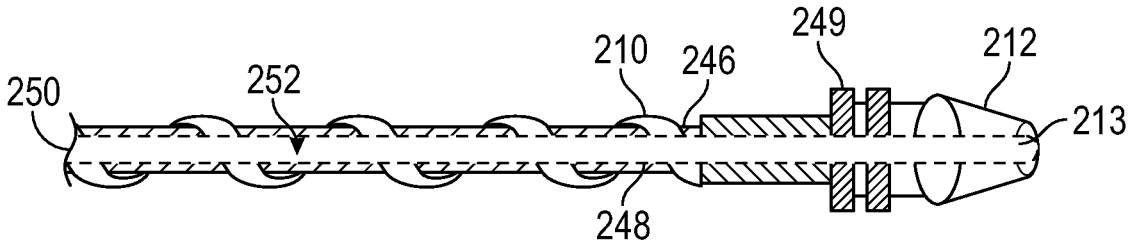
FIG. 5 shows a piston and a set of springs in accordance with one or more embodiments.

FIG. 5 shows the piston (212) and set of springs (210) in accordance with one or more embodiments. The set of springs (210) are wrapped around an outer surface (246) of a spring body (248). The spring body (248) is able to expand and retract with the set of springs (210). The spring body (248) has a spring end (250) that may be connected to the isolation valve (206). The piston (212) is connected to the spring body (248) opposite the spring end (250).

An aperture (252) extends through the inside of the spring body (248) and the piston (212) from the spring end (250) of the spring body (248) to a piston end (213) of the piston (212). Fluid may travel from the isolation valve (206) into the aperture (252) through the spring end (250). Fluid may exit the aperture (252) into the inside of the housing (208) through the piston end (213). In accordance with one or more embodiments, one or more seals (249) are also wrapped around the outer surface (246) of the spring body (248). The seals (249) prevent fluid from leaking into the housing (208) when exiting the piston end (213).

Turning back to FIGS. 2*a*-2*c*, the housing (208) is connected to the second power section (214) and the fluid may flow from the inside of the housing (208) into the second power section (214). The second power section (214) comprises a second rotor (254) and a second stator (256) and is configured to rotate when fluid is pumped from the housing (208). The second rotor (254) and the second stator (256) are designed and operate in a similar manner as the first rotor (203) and the first stator (205).

A reamer (220) is connected to the second power section (214) through the fixed valve (216) and the rotational valve (218). Through the rotational valve (218), the reamer (220) rotates in response to rotation of the second power section (214). The fixed valve (216) is located within the tubing of the downhole tripping and cementing tool (200) and prevents the outer portion of the second power section (214) from rotating. The reamer (220) may be any type of reamer known in the art and may be used to clean out the wellbore (102) as the tubular body is being tripped into the wellbore (102). The fluid may travel from the second power section (214) into the reamer (220). The fluid may exit the downhole tripping and cementing tool (200) through the reamer (220).

Figure 6:
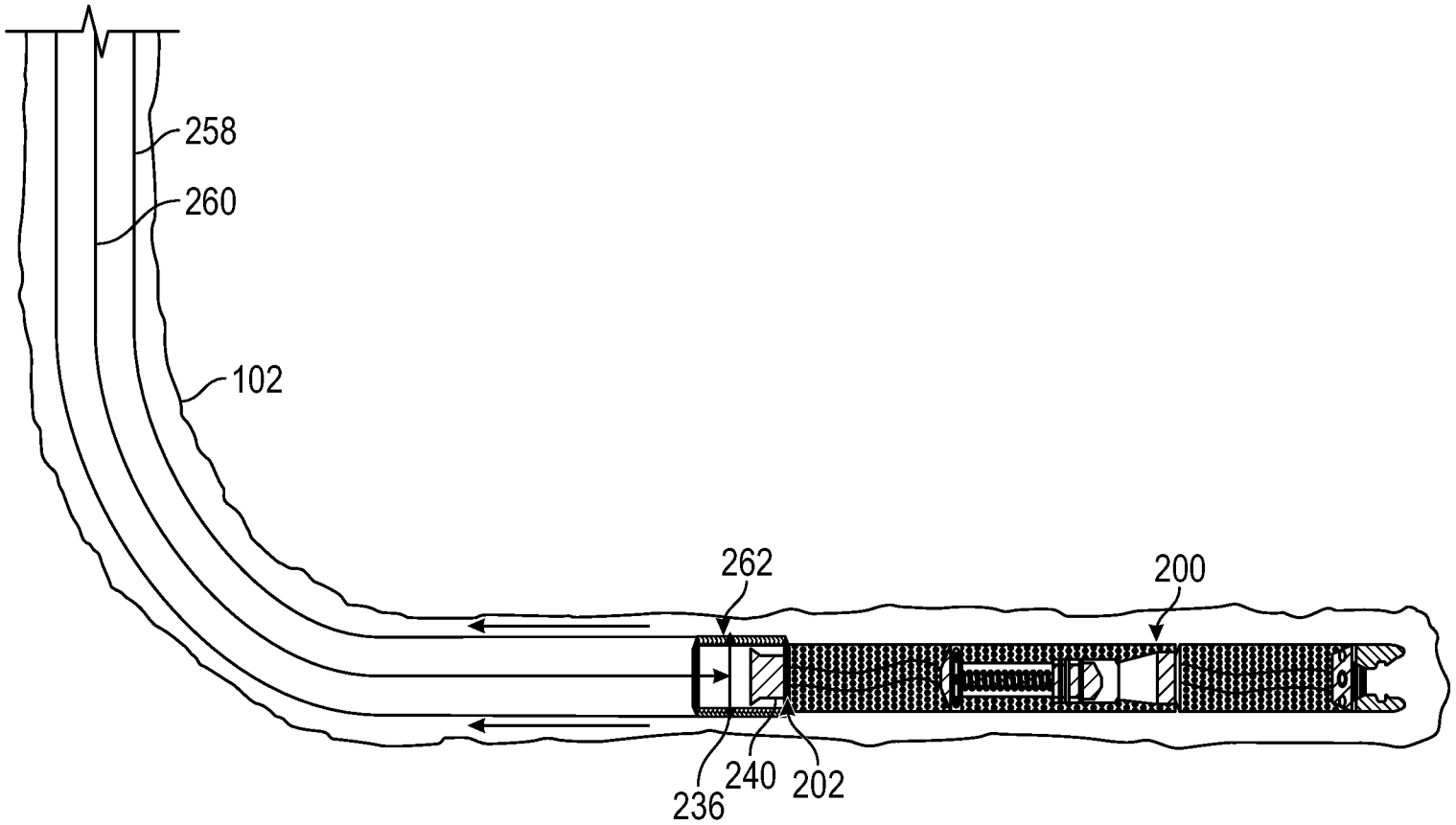
FIG. 6 shows the downhole tripping and cementing tool deployed in a wellbore in accordance with one or more embodiments.

FIG. 6 shows the downhole tripping and cementing tool (200) connected to a tubular body (258) deployed in a wellbore (102) in accordance with one or more embodiments. Components shown in FIG. 6 that are the same as or similar to components shown in FIGS. 1-5 have not been redescribed for purposes of readability and have the same description and function as outlined above.

The tubular body (258) may be a casing string or a liner string without departing from the scope of the disclosure herein. The downhole tripping and cementing tool (200) is connected to the downhole portion of the tubular body (258) such that the downhole tripping and cementing tool (200) enters the wellbore (102) prior to the tubular body (258).

FIG. 6 specifically shows the tubular body (258) and the downhole tripping and cementing tool (200) after the system has been tripped (i.e., lowered) into the wellbore (102) and while the tubular body (258) is undergoing a cementing operation. When the downhole tripping and cementing tool (200) is being tripped into the wellbore (102) the downhole tripping and cementing tool (200) may be in the active position or the inactive portions.

In accordance with one or more embodiments, the downhole tripping and cementing tool (200) is in the inactive position until the system has difficulty being lowered into the wellbore (102). At such a time, a fluid, such as a drilling fluid, may be pumped through the tubular body (258) into the downhole tripping and cementing tool (200) to place the downhole tripping and cementing tool (200) into the active position.

The active position will cause the piston (212) to pulsate and the reamer (220) to rotate. The pulsation exerts an axial force on the system and the rotation exerts a rotational force on the system enabling the tubular body (258) to be tripped to a desired depth in the wellbore (102). After the tubular body (258) has been lowered to the desired depth, the dart (240) may be pumped into the system to place the downhole tripping and cementing tool (200) in the cementing position, as shown in FIG. 6.

In FIG. 6, cement (260) is shown being pumped through the tubular body (258) into the PAC valve (202) of the downhole tripping and cementing tool (200) while the PAC valve (202) is in the cementing position. The cement (260) exits the downhole tripping and cementing tool (200) into an annulus (262) through the circulation ports (236) of the PAC valve (202). The annulus (262) is the space located between the tubular body (258) and the wellbore (102). The cement (260) may be pumped to a set height in the annulus (262) in order to cement the tubular body (258) in place.

The pressure of the cement (260) being pumped into the downhole tripping and cementing tool (200), on top of the dart (240), keeps the PAC valve (202) in the cementing position. The PAC valve (202) may be placed back in the tripping position when pressure is released. This prevents cement (260) flow back into the tubular body (258). Any cementing operation using any combination of spacer fluid, cement, displacement fluid, wiper plugs/darts, etc. may be performed without departing from the scope of the disclosure herein.

Figure 7:
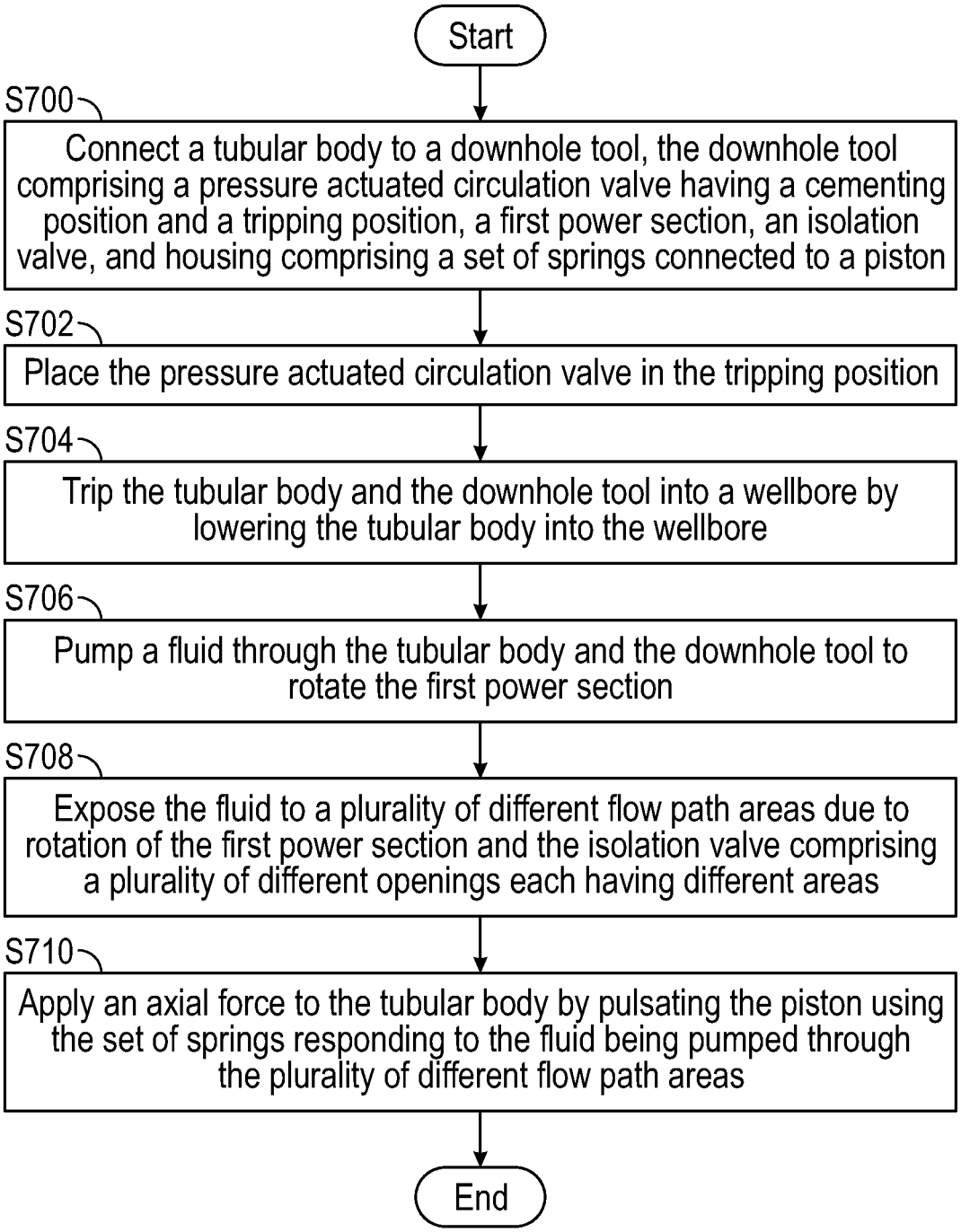
FIG. 7 shows a flowchart in accordance with one or more embodiments.

FIG. 7 shows a flowchart in accordance with one or more embodiments. The flowchart outlines a method for tripping and cementing a tubular body (258) into a wellbore (102). While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In step 700, a tubular body (258) is connected to a downhole tool, the downhole tool comprising a PAC valve (202) having a cementing position and a tripping position, a first power section (204), an isolation valve (206), and housing (208) comprising a set of springs (210) connected to a piston (212). In accordance with one or more embodiment, the downhole tool is the downhole tripping and cementing tool (200) outlined above in FIGS. 2-6.

In further embodiments, the downhole tripping and cementing tool (200) also includes a second power section (214) connected to a reamer (220) through a rotational valve (218) and a fixed valve (216). The tubular body (258) may be connected to the first end (232) of the PAC valve (202) of the downhole tripping and cementing tool (200). The downhole tripping and cementing tool (200) may be connected to a downhole portion of the tubular body (258).

The downhole tripping and cementing tool (200) may be assembled prior to deployment to the well site (100) or the downhole tripping and cementing tool (200) may be assembled at the well site (100) without departing from the scope of the disclosure herein. Further the connections between all the components of the tubular body (258) and the downhole tripping and cementing tool (200) may be any type of connections known in the art.

In step 702, the PAC valve (202) is placed in the tripping position. In accordance with one or more embodiments, the tripping position may be the natural position of the PAC valve (202). The tripping position occurs when there is no dart (240) landed in the dart seat (230) and the sleeves (238) are covering the circulation ports (236) of the PAC valve (202).

In step 704, the tubular body (258) and the downhole tool are tripped into a wellbore (102) by lowering the tubular body (258) into the wellbore (102). The downhole tripping and cementing tool (200) is lowered into the wellbore (102) first followed by the tubular body (258). While the system is being lowered into the wellbore (102), the downhole tripping and cementing tool (200) may be placed in the active position or the inactive position without departing from the scope of the disclosure herein.

In accordance with one or more embodiments, the downhole tripping and cementing tool (200) may be in the active position when downhole obstructions are encountered and/or the system is having difficulty reaching the required depth within the wellbore (102). In both the active and inactive position, the PAC valve (202) is placed in the tripping position. In the active position, a fluid is being pumped through the downhole tripping and cementing tool (200) to activate the first power section (204) and the second power section (214).

As such, and in step 706, a fluid is pumped through the tubular body (258) and the downhole tool to rotate the first power section (204). In step 708, the fluid is exposed to a plurality of different flow path areas (244) due to rotation of the first power section (204) and the isolation valve (206) comprising a plurality of different openings (242) each having different areas (244).

In step 710, an axial force is applied to the tubular body (258) by pulsating the piston (212) using the set of springs (210) responding to the fluid being pumped through the plurality of different flow path areas (244). The fluid exits the piston (212) into the housing (208) and enters the second power section (214) from the housing (208). The fluid is pumped into the second power section (214) to rotate the reamer (220) via the fixed valve (216) and the rotational valve (218).

Rotation of the reamer (220), and rotation of the tubular body (258) from the surface, places a rotational force on the system. The rotational force and the axial force may act together to trip the tubular body (258) to the required depth int eh wellbore (102). Further, rotation of the reamer (220) aids in clearing the wellbore (102) of ledges and/or debris.

Once the tubular body (258) and the downhole tripping and cementing tool (200) have bene lowered to the required depth, the tubular body (258) may be cemented in place by placing the PAC valve (202) in the cementing position. Placing the PAC valve (202) in the cementing position also places the downhole tripping and cementing tool (200) into the cementing position.

The PAC valve (202) is placed into the cementing position by pumping a dart (240) into the dart seat (230) of the PAC valve (202). The dart (240) landed in the dart seat (230) prevents fluid from being pumped through the downhole tripping and cementing tool (200). Thus, pressure may be built up within the PAC valve by continuing to pump a fluid on top of the dart (240). The pressure may cause the sleeves (238) to uncover the circulation ports (236). Once the circulation ports are uncovered, cement (260) may be pumped from the PAC valve (202) into the annulus (262) through the circulation ports (236) and the tubular body (258) may be cementing in the wellbore (102).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system comprising:

a tubular body deployed in a wellbore;

a pressure actuated circulation valve connected to the tubular body and having a cementing position and a tripping position, wherein the pressure actuated circulation valve is configured to be placed in the cementing position while the tubular body is being cemented in the wellbore and the pressure actuated circulation valve is configured to be placed in the tripping position while the tubular body is being lowered into the wellbore;

a first power section connected to the pressure actuated circulation valve, wherein the first power section is configured to rotate when a fluid is pumped from the pressure actuated circulation valve in the tripping position;

an isolation valve connected to the first power section, wherein the isolation valve comprises a plurality of openings each having a different area and the fluid is exposed to a plurality of different flow path areas when the first power section rotates and the fluid is pumped through the plurality of openings; and a housing connected to the isolation valve, the housing comprising a set of springs connected to a piston, wherein the set of springs are configured to pulsate the piston in response to the fluid being pumped through the plurality of different flow path areas and pulsation of the piston creates an axial force acting on the tubular body.

2. The system of claim 1, wherein the pressure actuated circulation valve further comprises a plurality of sleeves and a plurality of cementing ports.

3. The system of claim 2, wherein the tripping position comprises the plurality of sleeves covering the plurality of cementing ports.

4. The system of claim 2, further comprising a dart landed on a dart seat located within the pressure actuated circulation valve.

5. The system of claim 4, wherein the cementing position comprises the plurality of sleeves uncovering the plurality of cementing ports with the dart landed in the dart seat.

6. The system of claim 1, further comprising a second power section connected to the housing.

7. The system of claim 6, wherein the second power section is configured to rotate when the fluid is pumped from the housing.

8. The system of claim 7, further comprising a reamer connected to the second power section.

9. The system of claim 8, wherein the reamer is configured to rotate in response to rotation of the second power section.

10. The system of claim 8, wherein the reamer is connected to the second power section through a rotational valve and a fixed valve.

11. A method comprising:

connecting a tubular body to a downhole tool, the downhole tool comprising a pressure actuated circulation valve having a cementing position and a tripping position, a first power section, an isolation valve, and housing comprising a set of springs connected to a piston;

placing the pressure actuated circulation valve in the tripping position;

tripping the tubular body and the downhole tool into a wellbore by lowering the tubular body into the wellbore;

pumping a fluid through the tubular body and the downhole tool to rotate the first power section;

exposing the fluid to a plurality of different flow path areas due to rotation of the first power section and the isolation valve comprising a plurality of different openings each having different areas; and applying an axial force to the tubular body by pulsating the piston using the set of springs responding to the fluid being pumped through the plurality of different flow path areas.

12. The method of claim 11, further comprising cementing the tubular body in the wellbore.

13. The method of claim 12, wherein cementing the tubular body in the wellbore further comprises placing the pressure actuated circulation valve in the cementing position.

14. The method of claim 13, wherein placing the pressure actuated circulation valve in the cementing position comprises landing a dart in a dart seat of the pressure actuated circulation valve.

15. The method of claim 14, wherein placing the pressure actuated circulation valve in the cementing position further comprises uncovering a plurality of cementing ports in the pressure actuated circulation valve by pumping the fluid on the dart landed in the dart seat.

16. The method of claim 11, wherein the downhole tool further comprises a second power section and a reamer.

17. The method of claim 16, wherein tripping the tubular body and the downhole tool into the wellbore comprises rotating the reamer.

18. The method of claim 17, wherein rotating the reamer further comprises rotating the second power section connected to the housing.

19. The method of claim 18, wherein rotating the second power section further comprises pumping the fluid from the housing to the second power section.

20. The method of claim 19, wherein rotating the reamer further comprises connecting the reamer to the second power section using a rotational valve and a fixed valve.

* * * * *